US007959452B2

(12) United States Patent
Komiyama

(10) Patent No.: US 7,959,452 B2
(45) Date of Patent: Jun. 14, 2011

(54) LEVER-TYPE CONNECTOR

(75) Inventor: Ryuichi Komiyama, Tokyo (JP)

(73) Assignee: Tyco Electronics Japan G.K., Kanagawa-ken (JP)

( * ) Notice: Subject to any disclaimer, the term of this patent is extended or adjusted under 35 U.S.C. 154(b) by 0 days.

(21) Appl. No.: 12/892,338

(22) Filed: Sep. 28, 2010

(65) Prior Publication Data

US 2011/0021047 A1 Jan. 27, 2011

Related U.S. Application Data

(63) Continuation of application No. PCT/JP2009/055276, filed on Mar. 18, 2009.

(30) Foreign Application Priority Data

Mar. 28, 2008 (JP) ..... 2008-087618

(51) Int. Cl.
*H01R 13/62* (2006.01)

(52) U.S. Cl. ..... 439/157

(58) Field of Classification Search ..... 439/157, 439/372

See application file for complete search history.

(56) References Cited

U.S. PATENT DOCUMENTS 7,794,248 B2 * 9/2010 Kobayashi ..... 439/157
7,811,104 B2 * 10/2010 Matsumura et al. ..... 439/157
7,837,485 B2 * 11/2010 Epe et al. ..... 439/157

FOREIGN PATENT DOCUMENTS

JP 4-160775 A 6/1992
JP 2006-331991 A 12/2006
JP 2007-234420 A 9/2007

OTHER PUBLICATIONS

International Search Report for issued co-pending International Application No. PCT/JP2009/0055276, 1 page, dated Jun. 23, 2009.

* cited by examiner

*Primary Examiner* — Khiem Nguyen
(74) *Attorney, Agent, or Firm* — Barley Snyder LLC

(57) ABSTRACT

A lever-type connector capable of detecting displacement of a slider within a housing is provided. The lever-type connector includes a housing that has a contact receiving passageway for receiving a contact, a movable slider that is received within the housing, and a lever that can rotate between a mating start position and a mating completion position. By positioning the lever to the mating completion position, the slider is set to a mating position, thereby completing mating with a mating connector. The lever-type connector further includes an inspection hole that corresponds and communicates with a cam groove only when the slider is set to the mating position. The inspection hole is provided on a front surface of the housing.

16 Claims, 8 Drawing Sheets

Prior Art

LEVER-TYPE CONNECTOR

CROSS-REFERENCE TO RELATED APPLICATIONS

This application is a continuation of PCT International Application No. PCT/JP2009/055276, filed Mar. 18, 2009, which claims priority under 35 U.S.C. §119 to Japanese Patent Application No. JP 2008-087618, filed Mar. 28, 2008.

FIELD OF THE INVENTION

The present invention relates to a connector, and in particular to a lever-type connector to unite and release from a mating connector by rotation of a lever.

BACKGROUND

In recent years, electric connectors having numerous terminals are being used in the field of automobiles and the like, and are continually become more and more advanced. With an electric connector having numerous terminals, a large force is necessary to mate together connectors and release the connection. Therefore, in the field of automobiles and the like, a lever-type connector to mate with and release from a mating connector utilizing effect of boosting by a lever is used.

FIG. 13 is a cross-sectional view of a conventional lever-type connector, which includes a connector housing 110 receiving a contact (not illustrated in the drawing), a pair of sliders 120 accommodated in the connector housing 110, and a lever 130 that can be rotated relative to the connector housing 110.

The connector housing 110 includes a slider receiving slot 111 that receives the respective sliders 120. Moreover, a wire cover 140 that covers an electrical wire lead out from the contact (not illustrated in the drawing) is attached on the rear surface side of the connector housing 110.

A cam groove 121 is provided on the respective sliders 120 into which a cam pin 210 of a mating connector 200 is inserted. Moreover, a rack 122 is provided on the respective sliders 120, which engages with gears 131 of the lever 130. By rotating the lever 130, the gears 131 of the lever 130 drive the rack 122 for each slider 120, moving the sliders 120 in the left-and-right direction (left-and-right direction in FIG. 13). By moving the sliders 120 in the left-and-right direction, the cam grooves 121 of the sliders 120 direct in and push out the cam pins 120 that are inserted into the cam grooves 121. In this manner, the lever-type connector 100 can mate with and release from the mating connector 200 by rotating the lever 130.

When assembling the lever-type connector 100, a contact is first received in the connector housing 110 that receives the sliders 120, and the wire cover 140 and the lever 130 are then attached to the connector housing 110.

When attaching the lever 130 to the connector housing 110, teeth of the gears 131 of the lever 130 are positioned to engage teeth of the rack 122 according to a predetermined configuration. As a result, the lever-type connector 100 adopts a configuration that allows temporary fastening of the sliders 120 at predetermined mating positions. Additionally, projections (not illustrated in the drawing) are provided on the sliders 120, and these projections join with depressions (not illustrated in the drawing) provided on the slider receiving slots 111 of the connector housing 110.

In recent years, the size of these lever-type connectors has become smaller, wherein a slider is received within a housing which does not allow the slider to be seen from the outside. Furthermore, the slider does not protrude outside of the housing even upon movement. As a result, the slider cannot be seen from the outside, and position of the slider within the housing cannot be detected externally. Therefore, with the type of lever-type connector from which the slider cannot be seen from the outside, even in the case where displacement of a slider that has been temporarily fastened at a mating position within a housing, because of impact or the like during transportation, that displacement of the slider cannot be detected. Moreover, with the lever-type connector, if attachment of a lever is carried out in a state where displacement of a slider has occurred within a housing, gears of the lever and a rack of the slider are not properly engaged with together, nor can mating with and releasing from a mating connector be carried out.

Namely, with the type of lever-type connector from which the slider cannot be seen from the outside, since displacement of the slider cannot be detected externally, there is a problem in that the gears of the lever cannot properly engage with a rack for a slider when attaching the lever.

SUMMARY

The invention has been made to solve the above problems in the conventional lever-type connector, and it is an objective of the invention to provide a lever-type connector capable of detecting displacement of a slider within a housing.

The lever-type connector according to invention includes a housing that has a contact receiving passageway for receiving a contact, a movable slider that is received within the housing, and a lever that can rotate between a mating start position and a mating completion position. By positioning the lever to the mating completion position, the slider is set to a mating position, thereby completing mating with a mating connector. The lever-type connector further includes an inspection hole that corresponds and communicates with a cam groove only when the slider is set to the mating position. The inspection hole is provided on a front surface of the housing.

BRIEF DESCRIPTION OF THE DRAWINGS

The invention is described in more detail in the following with reference to the embodiments shown in the drawings. Similar or corresponding details in the Figures are provided with the same reference numerals. The invention will be described in detail with reference to the following figures of which.

DETAILED DESCRIPTION OF THE EMBODIMENT(S)

Hereinafter, a lever-type connector 1 according to the invention will be described with reference to the drawings.

Figure 1:
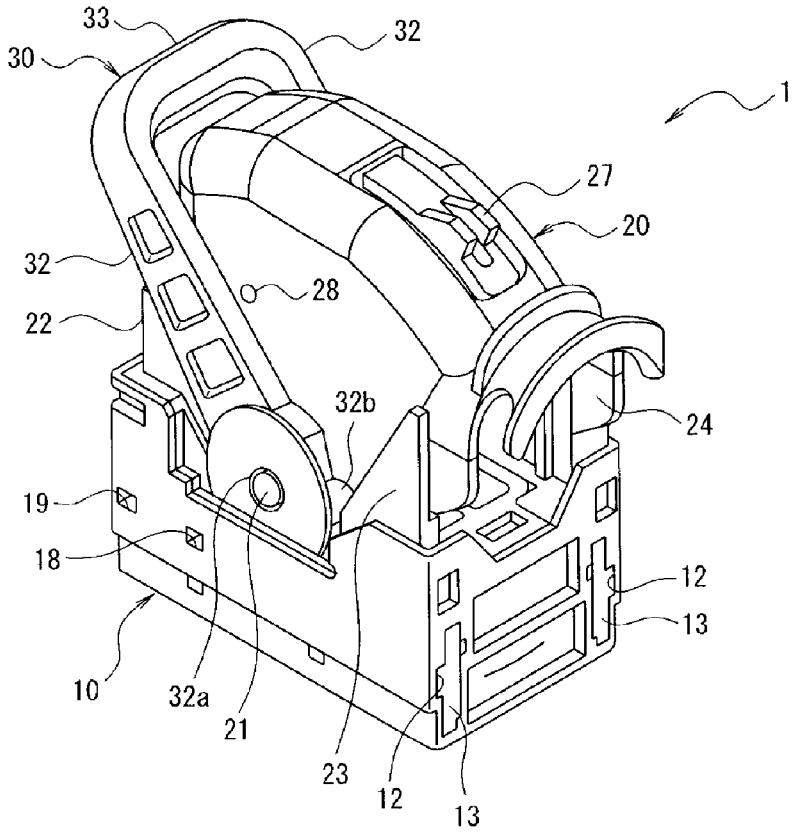
FIG. 1 is a perspective view of a lever-type connector according to invention, set to a mating start position.
Figure 2:
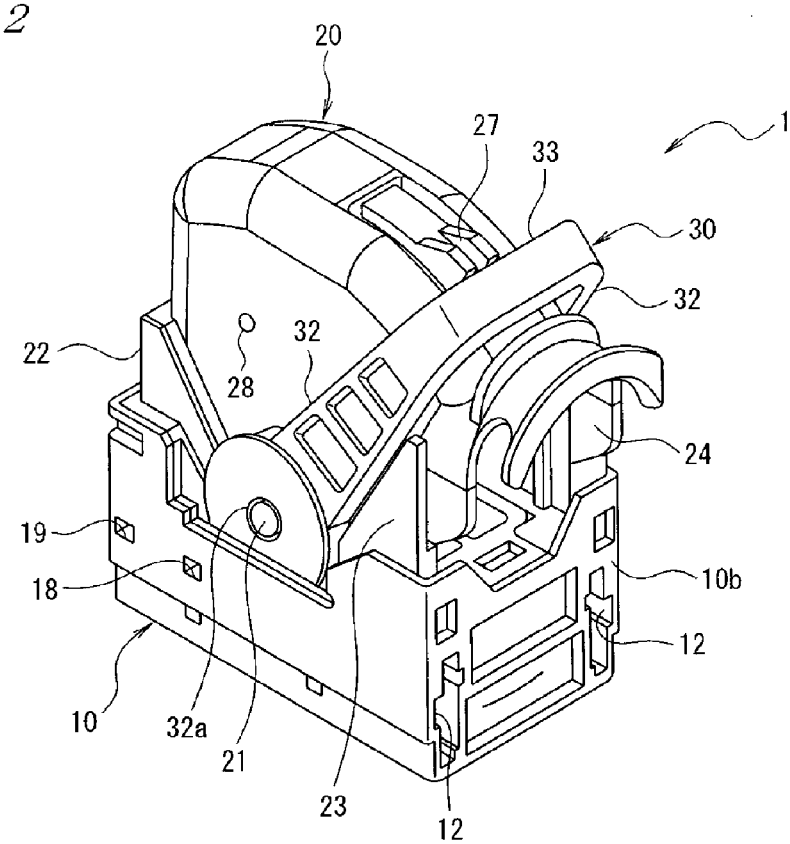
FIG. 2 is a perspective view of the lever-type connector of FIG. 1, set to a mating completion position.

The lever-type connector 1 shown in FIG. 1 and FIG. 2 includes a housing 10, which shields multiple contacts (not illustrated in the drawings), a wire cover 20, which is attached to the rear surface side (upper side in FIG. 1 and FIG. 2) of the housing 10, and a lever 30, which is attached to the wire cover 20.

Figure 3:
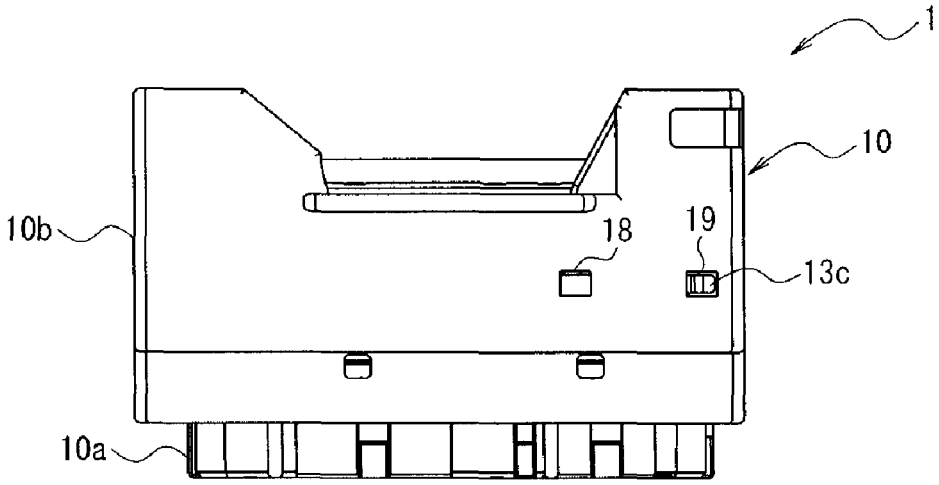
FIG. 3 is a plan view of a housing of the lever-type connector according to the invention.
Figure 4:
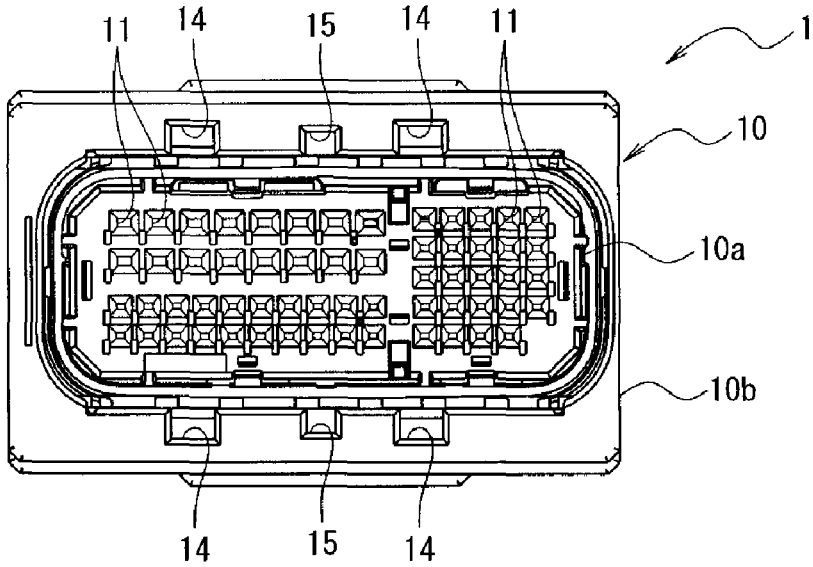
FIG. 4 is a front view of the housing of FIG. 3.

The housing 10 is formed having an inner housing 10*a* and an outer housing 10*b* that covers the inner housing 10*a*. In the embodiment shown, the housing 10 extends in a longitudinal direction (FIG. 3 and FIG. 4). The inner housing 10*a* has multiple contact receiving passageways 11 that penetrate through.

As shown in FIG. 2, a slider receiving slot 12 on either inner surface of the outer housing 10*b* is provided. A slider 13 is received in each of the sliding receiving slots 12, as shown in FIG. 1. Each of the sliders 13 is received in a slider receiving slot 12 so as to freely move between a release position (see FIG. 12) and a mating position (see FIG. 8 and FIG. 10).

As shown in FIG. 4, four cam pin receiving passageways 14 are positioned on the front surface of the outer housing 10*b*, into which cam pins (not illustrated in the drawing) provided on the mating connector are inserted. The respective cam pin receiving passageways 14 are positioned so as to communicate with the respective cam grooves 13*a* of the respective sliders 13 only when the sliders 13 are set to the release position. Moreover, two insertion pin passageways 15 are positioned on the front surface of the outer housing 10*b*, into which insertion pins 51 of a stationary tool 50 described later are inserted. The respective insertion pin passageways 15 are positioned so as to communicate with the respective cam grooves 13*a* on one end side of the respective sliders 13 in the left-and-right direction only when the sliders 13 are set to the mating position.

A first temporary fastening hole 18 and a second temporary fastening hole 19 into which projections 13*c* of the respective sliders 13 are joined are positioned on the top and bottom surfaces of the outer housing 10*b* (see FIG. 3). The first temporary fastening hole 18 is positioned in order to join to projections 13*c* of the respective sliders 13, when the sliders 13 are set to the release position. The second temporary fastening hole 19 is positioned in order to join to the projections 13*c* of the respective sliders 13 when the sliders 13 are set to the mating position.

Figure 8:
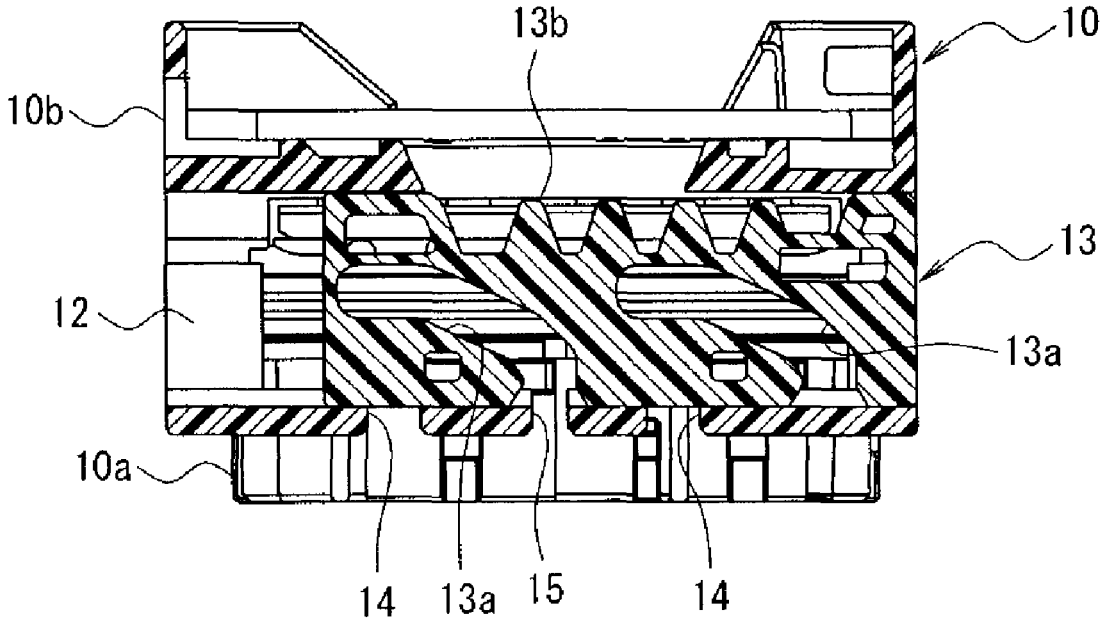
FIG. 8 is a cross-sectional view of the housing and the stationary tool of FIG. 7.
Figure 8:
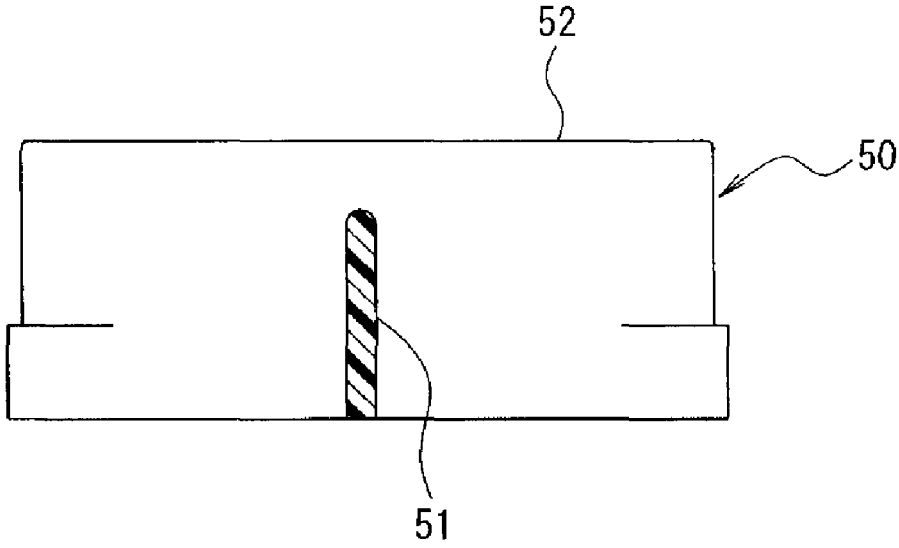

As shown in FIG. 8, each of the sliders 13 are manufactured having a plate shape, extending in the left-and-right direction. Two of the cam grooves 13*a* are provided on the inner surface of each of the sliders 13, which direct cam pins that of the mating connector. Moreover, a rack 13*b* with which gears 32*b* of the lever 30 are engaged is provided on the rear surface side of the respective sliders 13.

A projection 13*c* is positioned on the other end of the respective sliders 13 in (see FIG. 3), which is used to temporarily fasten the sliders 13 at the release position or the mating position. Each slider 13 can be temporarily fastened at the release position by joining the projection 13*c* to the first temporary fastening hole 18 of the outer housing 10*b*, or temporarily fastened at the mating position by joining the projection 13*c* to the second temporary fastening hole 19 of the outer housing 10*b*.

The lever 30 includes a pair of side plates 32 and a connecting part 33 for connecting ends of both of the side plates 32 to each other, as shown in FIG. 1 and FIG. 2. A pivot receiving passageway 32*a* into which a projection 21 of the wire cover 20 is joined is provided on the other ends of both of the side plates 32. Moreover, a gear 32*b* that engages with the rack 13*b* of the housing 10 is provided around the pivot receiving passageway 32*a* on the other ends of both of the side plates 32. The wire cover 20 is formed in an approximate box shape so as to cover an electrical wire (not illustrated in the drawing) which connects to the contacts positioned in the housing 10, as shown in FIG. 1 and FIG. 2.

The projection 21 that joins to the pivot receiving passageway 32*a* of the lever 30 is provided on the front end of the top and bottom surfaces of the wire cover 20.

A first stopper 22 is provided on one side of the wire cover 20 in the left-and-right direction. A second stopper 23 is provided on the other side of the wire cover 20. The first stopper 22 deters the lever 30 that has been set to the mating start position (see FIG. 1) from rotating further toward the one side. The second stopper 23 blocks the lever 30 that has been set to the mating completion position (see FIG. 2) from rotating further toward the other side. An electrical wire outlet 24 is provided on the other end of the wire cover 20. A lock 27 for preventing rotation of the lever 30, which has been set to the mating completion position, to the one side is provided on the rear surface of the wire cover 20. The lock 27 is manufactured in a cantilever plate-spring form and prevents the lever 30 from rotating toward the one side by intercepting the sides of the connecting part 33 of the lever 30 set to the mating completion position. A lock projection portion 28 for preventing rotation of the lever 30, when set to the mating start position, to the other side is provided on ends of the top and bottom surfaces of the wire cover 20. Each lock projection portions 28 prevents rotation of the lever 30, set to the mating start position, to the other side in the left-and-right direction by intercepting the sides of the respective side plates 32 of the lever 30.

Figure 5:
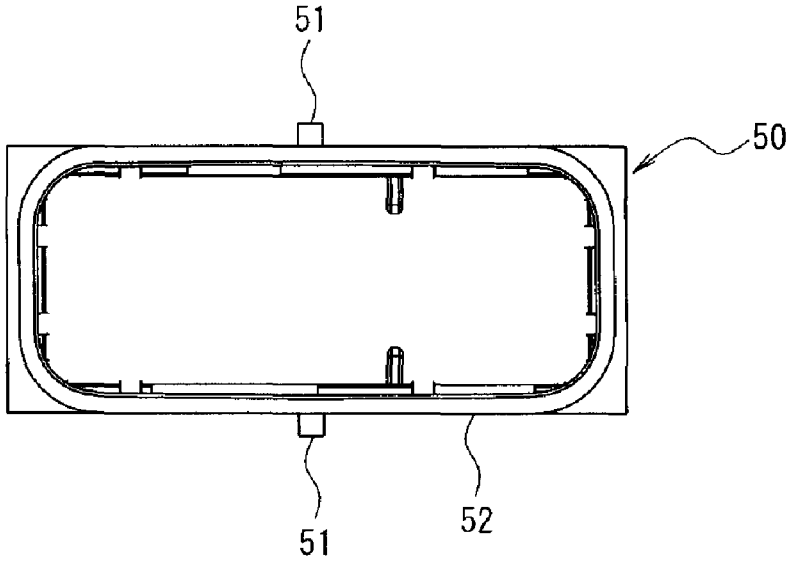
FIG. 5 is a front view of a stationary tool according to the invention.
Figure 6:
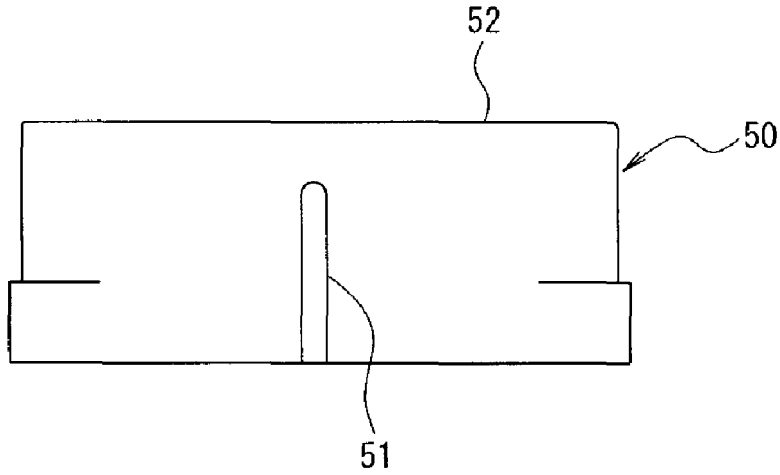
FIG. 6 is a front view of the stationary tool of FIG. 5.

The stationary tool 50 used when assembling the lever-type connector 1 will now be described. The stationary tool 50 includes a hood portion 52, which is inserted between the inner housing 10*a* and the outer housing 10*b* of the housing 10 and encloses the inner housing 10*a*, as shown in FIG. 5 and FIG. 6. The hood portion 52 is formed with the front surface side having a tube shape. An insertion pin 51 is provided on the top and the bottom surfaces of the hood portion 52. The inspection pin 51 is inserted into respective insertion pin passageways 15 of the outer housing 10*b*.

A method of assembly method for the lever-type connector 1 according to the invention will now be described.

A wire cover 20 having an installed lever 30 is brought in assembly with the housing 10. The housing 10 receives the sliders 13, and the lever 30 may be fixed by a lock 27, when the lever 30 is set to a mating completion position. The lock 27 prevents damage to the lever 30. Moreover, the sliders 13 include projections 13*c* which join with a second temporary fastening hole 19 when the sliders 13 are set to the mating completion position. As a result, if the wire cover 20 is combined with the housing 10, when the lever 30 and sliders 13 are set to the mating position, respective gears 32*b* of the lever 30 and the rack 13*b* of the respective sliders 13 are properly engaged with each other.

Detection of the positions of the sliders 13 within the housing 10 is not possible externally, especially when the slider 13 is displaced from a mating position because of impact or the like during transportation. However, according to the invention, a stationary tool 50 is provided with the lever-type connector 1, so that displacement of the sliders 13 in the housing 10 may be detected is possible.

Namely, when assembling the lever-type connector 1, multiple contact receiving passageways 11 of the housing 10 first receive the contacts, respectively. The contacts are received in the contact receiving passageways 11 of the housing 10 when the housing 10 is joined to the stationary tool 50.

Figure 7:
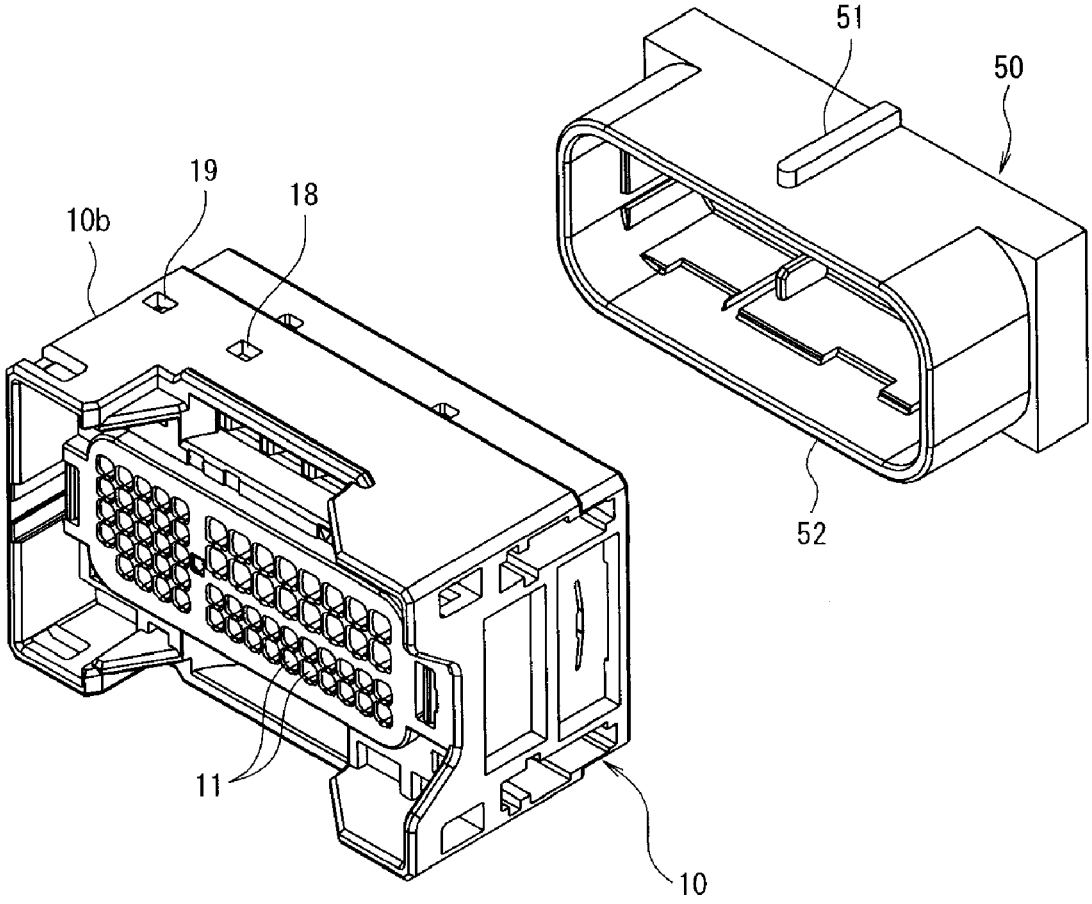
FIG. 7 is a perspective view a stationary tool and a housing according to the invention, in which a slider is set to a mating position.

When the housing 10 joins the stationary tool 50, the front surface of the housing 10 and the front surface of the frame-shaped hood portion 52 of the stationary tool 50 are arranged facing each other, as shown in FIG. 7 and FIG. 8.

Figure 9:
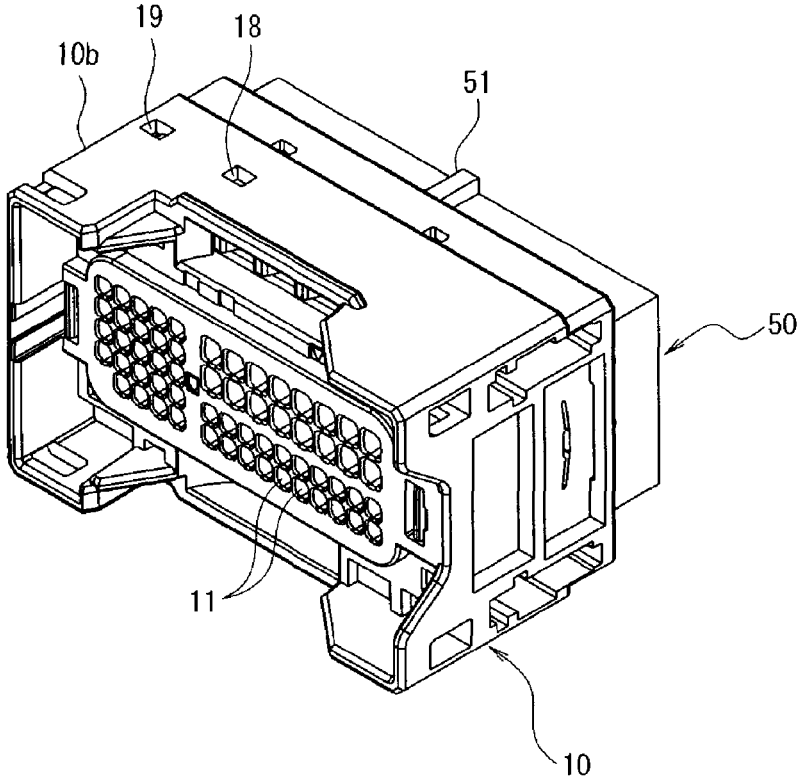
FIG. 9 is a perspective view of a stationary tool joined with a housing according to the invention, in which a slider within the housing is set to a mating position.
Figure 10:
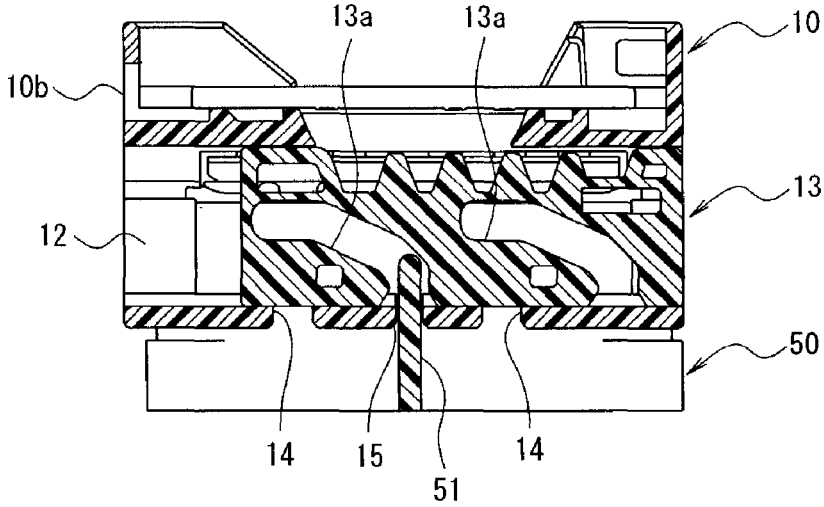
FIG. 10 is a cross-sectional view of the housing and the stationary tool of FIG. 9.

Then, the inner housing 10*a* of the housing 10 is inserted inside of the hood portion 52 of the stationary tool 50, as shown in FIG. 9 and FIG. 10. Here, as shown in FIG. 10, when the respective sliders 13 are at the mating position of the housing 10, the respective insertion pin passageways 15 of the outer housing 10*b* communicate and correspond with the cam grooves 13*a* on respective end sides of the respective sliders 13. Accordingly, the respective inspection pins 51 of the stationary tool 50 are inserted into the cam grooves 13*a* on one end side of the respective sliders 13 via the respective insertion pin passageways 15 of the outer housing 10*b*. This properly completes joining of the housing 10 to the stationary tool 50.

Figure 11:
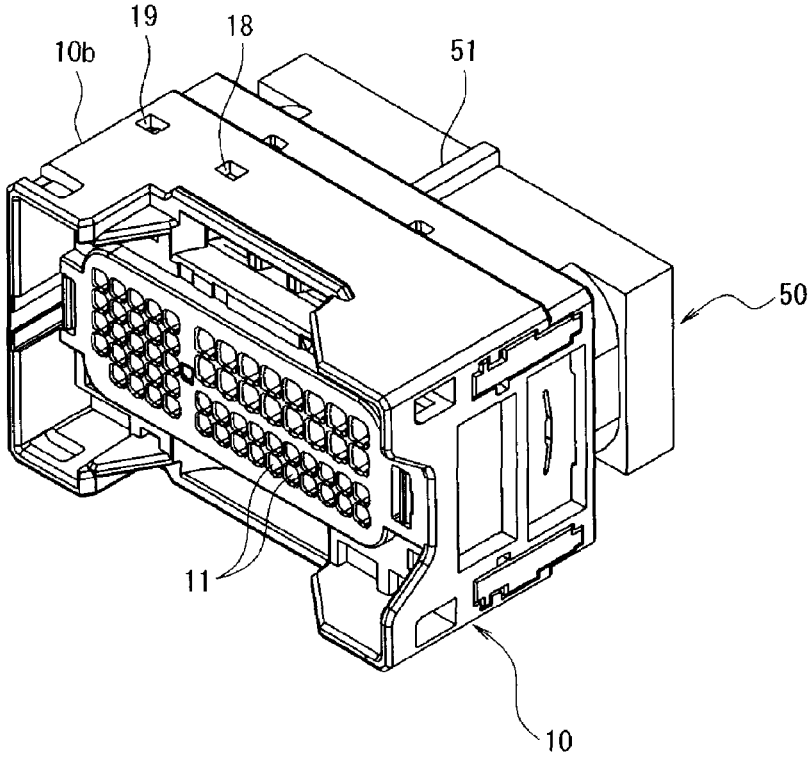
FIG. 11 is a perspective view of a stationary tool joined with a housing according to the invention, in which a slider within the housing is set to a release position.
Figure 12:
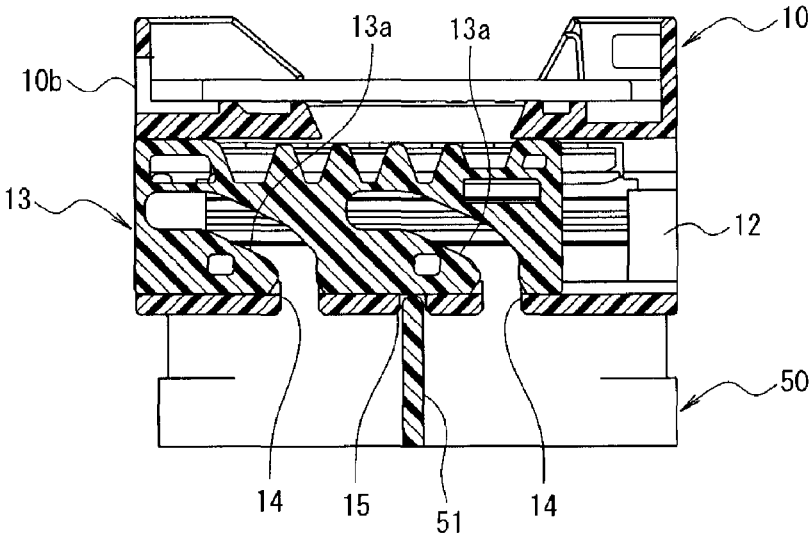
FIG. 12 is a cross-sectional view of the housing and the stationary tool of FIG. 11.
Figure 13:
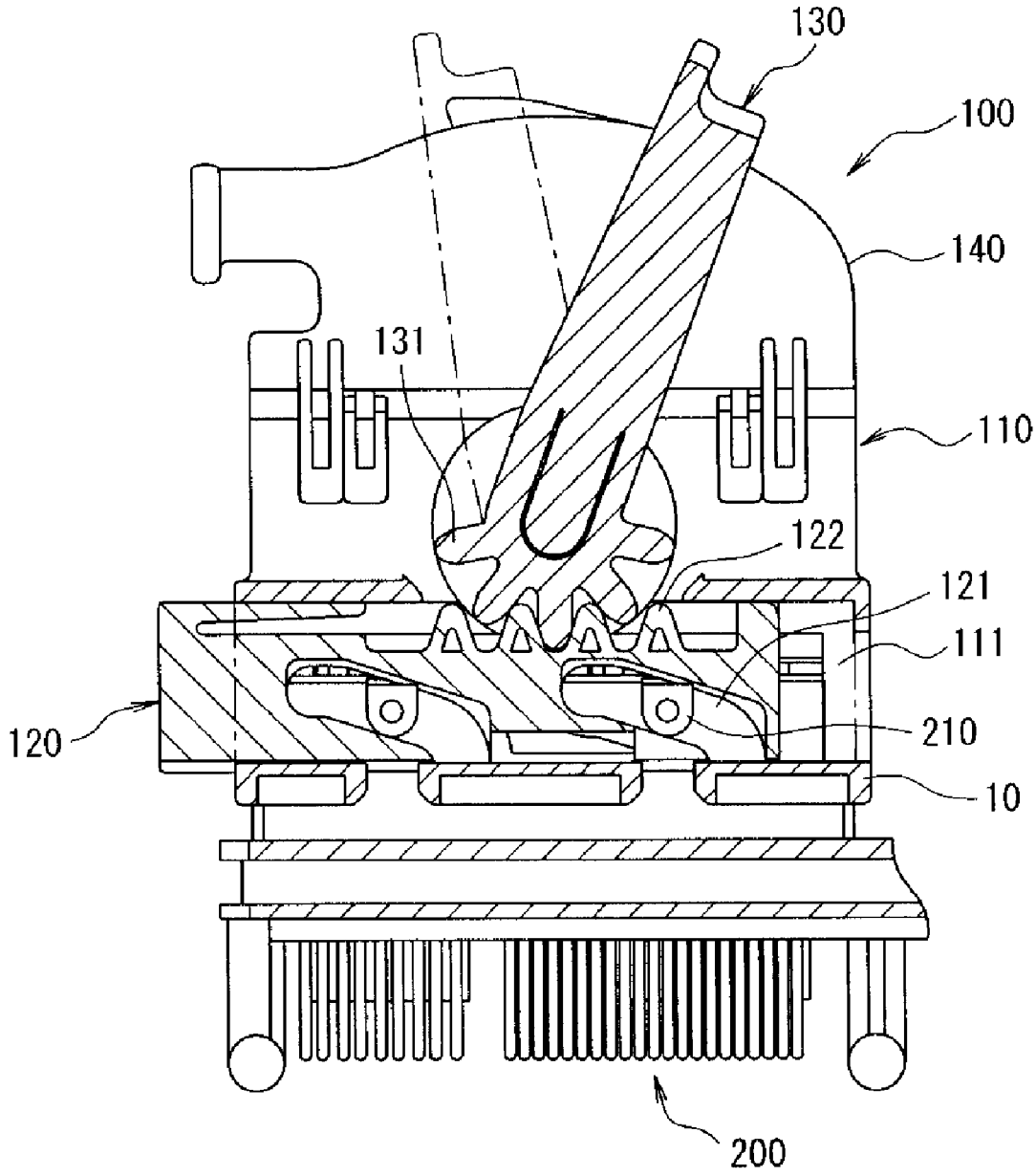
FIG. 13 is a cross-sectional view of a known conventional lever-type connector.

On the other hand, as shown in FIG. 11 and FIG. 12, when at least one of two sliders 13 is not at the mating position of the housing 10 (indicates case of when both of the two sliders 13 are at the release position of the housing 10 in FIG. 11 and FIG. 12), the cam grooves 13*a* on the one end side of the slider 13 not at the mating position does not communicate with the insertion pin passageway 15 of the outer housing 10*b*. Therefore, since an end of the inspection pin 51 of the stationary tool 50 does not make contact with the front end of the slider 13 and is not inserted into the cam groove 13*a*, joining of the housing 10 to the stationary tool 50 cannot be properly carried out.

As such, according to the lever-type connector 1, when joining the housing 10 to the stationary tool 50, detection of displacement of a slider 13 within the housing 10 is possible. Next, the contacts are accommodated in the multiple contact receiving passageways 11 of the housing 10, which has been properly joined to the stationary tool 50.

The wire cover 20 to which the lever 30 is attached is then attached to the housing 10 receiving the multiple contacts. In this case, as described above, the wire cover 20 is in a state where the lever 30 is set to the mating completion position and the lever 30 is fixed by the lock 27. Moreover, the housing 10 properly joined to the stationary tool 50 is in a state where the respective sliders 13 are set to the mating position and the projections 13*c* of the respective sliders 13 are joined to the second temporary fastening hole 19. As a result, the wire cover 20 where the lever 30 is set to the mating completion position is combined with the housing 10 where the respective sliders 13 are set to the mating position, thereby properly engaging the respective gears 32*b* of the lever 30 with the rack 13*b* of the respective sliders 13. Note that in the state where attachment of the wire cover 20 to the housing 10 is complete, the bound, electrical wires connected to the multiple contacts accommodated in the housing 10 are lead out from the electrical wire outlet 24 of the wire cover 20.

This attaches the wire cover 20 to the housing 10, thereby completing assembly of the lever-type connector 1, as shown in FIG. 2.

The assembled lever-type connector 1 is then removed from the stationary tool 50 once power distribution inspection and the like have been conducted.

A method of use of the lever-type connector 1 according to the invention will now be described.

With the lever-type connector 1, by rotating the lever 30 relative to the housing 10, the gears 32*b* of the lever 30 drive the rack 13*b* of the sliders 13, moving the sliders 13 in the left-and-right direction. Moreover, if the lever 30 is rotated toward the mating start position side, the sliders 13 are moved toward the release position side. Furthermore, if the lever 30 is rotated toward the mating completion position side, the sliders 13 are moved toward the mating position side. When the lever 30 is set to the mating start position, the sliders 13 are then set to the release position. Meanwhile, when the lever 30 is set to the mating completion position, the sliders 13 are then set to the mating position.

When mating the lever-type connector 1 with a mating connector, the lever 30 is first set to the mating start position. When the lever 30 has been set to the mating start position, the sliders 13 are set to the release position such that the respective cam pin receiving passageways 14 of the outer housing 10*b* communicate with the respective cam grooves 13*a* of the respective sliders 13.

Then, when the lever 30 has been set to the mating start position, the respective cam pins of the mating connector are inserted into the multiple cam grooves 13*a* of the sliders 13 through the respective cam pin receiving passageways 14 of the outer housing 10*b*, temporarily mating the lever-type connector 1 with the mating connector.

Next, the lever 30 that is locked by the lock projection portion 28 of the wire cover 20 is released, and the lever 30 that has been set to the mating start position is rotated toward the mating completion position side. Once the lever 30 is rotated toward the mating completion position side, the sliders 13 are moved toward the mating position so that the multiple cam grooves 13*a* of the sliders 13 lead the cam pins, which are provided to the mating connector, toward the rear surface side. As a result, the multiple contacts within the inner housing 10*a* of the lever-type connector 1 are mated with the contacts within in the mating connector.

The lever 30 is then set to the mating completion position such that the sliders 13 are set to the mating position, thereby completing mating of the lever-type connector 1 with the mating connector. Note that the lever 30 set to the mating completion position is prevented from rotating toward the mating start position side by the lock 27 of the wire cover 20.

Meanwhile, when releasing the mating of the lever-type connector 1 with the mating connector, the lever 30 locked by the lock 27 of the wire cover 20 is released, and the lever 30 that has been set to the mating completion position is rotated toward the mating start position side. Once the lever 30 is rotated toward the mating start position side, the sliders 13 are moved toward the release position side so that the multiple cam grooves 13*a* of the sliders 13 lead the cam pins, which are provided to the mating connector, out toward the front surface side. As a result, the mating of the contacts within the inner housing 10*a* of the lever-type connector 1 with the contacts within in the mating connector is released.

Once the lever 30 is rotated until the mating start position, release of the mating of the lever-type connector 1 with the mating connector is then complete.

While the embodiments of the present invention have been illustrated in detail, various modifications to those embodiments are possible. Those skilled in the art will appreciate that various modifications, additions and substitutions are possible, without departing from the scope and spirit of the invention as disclosed in the accompanying claims.

For example, while a configuration of detecting displacement of the slider 13 using the stationary tool 50 is used in the embodiments given above, a configuration of detecting displacement of the slider 13 using inserting detection pins or the like in the insertion pin passageways 15 of the outer housing 10*b* is also available.

Accordingly, the lever-type connector 1 according to invention makes it possible to detect displacement of a slider 13 within the housing 10.

What is claimed is:

1. A lever-type connector for mating with a mating connector comprising:

a housing having a contact receiving passageway for receiving a contact;

a slider movable within the housing and having a cam groove into which a cam pin provided on the mating connector is inserted;

a lever rotatable between a mating start position and a mating completion position to move the slider to a mating position; and an inspection hole positioned on a front surface of the housing and corresponds with the cam groove when the slider is set to the mating position.

2. The lever-type connector of claim 1, further comprising a projection positioned on the slider.

3. The lever-type connector of claim 2, further comprising a temporary fastening hole positioned on a surface of the housing to join with the projection when the slider is set to a release position.

4. The lever-type connector of claim 3, further comprising a second temporary fastening hole positioned in order to join with the projection when the slider is set to a mating position.

5. A lever-type connector for mating with a mating connector comprising:

a housing having a slider receiving slot;

a wire cover attached to a rear surface side of the housing;

a lever attached to the wire cover;

a slider received within the slider receiving slot; and a stationary tool having a hood portion that is inserted into the housing.

6. The lever-type connector according to claim 5, wherein the hood portion is formed with a front side having a tube shape.

7. The lever-type connector according to claim 6, further comprising an inspection pin provided on a surface of the hood portion.

8. The lever-type connector according to claim 7, further comprising an insertion hole positioned in the housing into which the inspection pin is inserted.

9. The lever-type connector according to claim 5, further comprising a rack positioned on a rear side of the slider.

10. The lever-type connector according to claim 6, further comprising gears on the lever to engage the rack.

11. The lever-type connector of claim 5, further comprising a projection positioned on the slider.

12. The lever-type connector of claim 11, further comprising a temporary fastening hole positioned on a surface of the housing to join with the projection when the sliders is set to a release position.

13. The lever-type connector of claim 12, further comprising a second temporary fastening hole positioned to join with the projection when the slider is set to a mating position.

14. The lever-type connector of claim 5, further comprising a stopper provided on the wire cover.

15. The lever-type connector of claim 5, further comprising a lock provided on a rear surface of the wire cover and preventing rotation of the lever when set to a mating completion position.

16. The lever-type connector of claim 15, wherein the lock is a cantilever plate-spring form lock.

* * * * *